US010418194B2

(12) United States Patent
Zhang

(10) Patent No.: US 10,418,194 B2
(45) Date of Patent: Sep. 17, 2019

(54) KEY STRUCTURE OF KEYBOARD

(71) Applicant: Jiangsu Transimage Technology Co., Ltd., Gaoyou, Jiangsu (CN)

(72) Inventor: Qing Zhang, Jiangsu (CN)

(73) Assignee: Jiangsu Transimage Technology Co., Ltd., Gaoyou, Jiangsu (CN)

( * ) Notice: Subject to any disclaimer, the term of this patent is extended or adjusted under 35 U.S.C. 154(b) by 13 days.

(21) Appl. No.: 15/803,361

(22) Filed: Nov. 3, 2017

(65) Prior Publication Data

US 2018/0269010 A1 Sep. 20, 2018

(30) Foreign Application Priority Data

Mar. 15, 2017 (CN) ..... 2017 1 0153354

(51) Int. Cl.

| | |
|---|---|
| ***H01H 3/12*** | (2006.01) |
| ***H01H 13/705*** | (2006.01) |
| ***H01H 13/7065*** | (2006.01) |
| *H01H 13/85* | (2006.01) |

(52) U.S. Cl.

CPC ..... *H01H 3/125* (2013.01); *H01H 13/705* (2013.01); *H01H 13/7065* (2013.01); *H01H 13/85* (2013.01); *H01H 2215/006* (2013.01)

(58) Field of Classification Search

CPC ..... H01H 3/125; H01H 13/705

USPC ..... 200/5 A, 344

See application file for complete search history.

(56) References Cited

U.S. PATENT DOCUMENTS

2012/0298496 A1* 11/2012 Zhang ..... H01H 3/125 200/5 A

2015/0101916 A1* 4/2015 Chen ..... H01H 3/125 200/5 A

* cited by examiner

*Primary Examiner* — Kyung S Lee

*Assistant Examiner* — Iman Malakooti

(74) *Attorney, Agent, or Firm* — Rankin, Hill & Clark LLP

(57) ABSTRACT

A key structure of a keyboard includes a keycap, a scissor connecting mechanism, a conductive circuit board and a bottom plate from top to bottom, wherein a projection is arranged between the scissor connecting mechanism and the conductive circuit board; when an optional position of the periphery of the keycap is pressed, the scissor connecting mechanism is in contact with the projection before the conductive circuit board or the bottom plate below the scissor connecting mechanism; and if the optional position of the periphery of the keycap continues being pressed, the scissor connecting mechanism positioned on one side of the pressed point is bent and deformed by using the projection as a fulcrum and is in contact with the conductive circuit board.

12 Claims, 5 Drawing Sheets

KEY STRUCTURE OF KEYBOARD

TECHNICAL FIELD

The present invention relates a key structure of a keyboard, and more particularly, to a key structure of a keyboard that may improve the hand pressing feeling on the periphery of a keycap.

BACKGROUND

A traditional key structure of a keyboard comprises a keycap 1, a scissor connecting mechanism 1, a conductive circuit board 3 and a bottom plate 4 from top to bottom, and further comprises an elastomer 8. An upper part of the elastomer 8 passes through an axle hole of the scissor connecting mechanism 2 and is butted with the keycap 1, while a bottom part of the elastomer is connected with the conductive circuit board 3. As illustrated in FIG. 1*a*, the elastomer 8 is usually corresponding to a middle part of the keycap 1. When the middle part of the keycap 1 is pressed to the bottom end, since the elastomer 8 has a buffer effect, neither the contact between the scissor connecting mechanism 2 and the keycap 1, nor the contact between the conductive circuit board 3 and the bottom plate 4 is strong collision, and the hand feeling is good.

However, when the periphery of the keycap is pressed as illustrated in FIGS. 1*b* to 1*c* which illustrate the matching status between the scissor connecting mechanism 2 and each part when the periphery of the keycap is pressed to the bottom end, the outer frame of the scissor connecting mechanism 2 collides with the keycap 1 while the inner frame collides with the conductive circuit board 3, as illustrated in FIG. 1*b*. It can be seen from FIG. 1*c* that, the inner scissor frame and the outer scissor frame of the scissor connecting mechanism 2 collide with each other, and the outer frame of the scissor connecting mechanism 2 collides with the bottom plate. That is, the scissor connecting mechanism 2 directly collides with the keycap 1, the conductive circuit board 3 and the bottom plate 4, which does not have any buffer, so that the hand pressing feeling is poor.

SUMMARY

Object of the invention: regarding to the problem of poor hand feeling when pressing the periphery of the keycap in the traditional key structure, the present invention provides a key structure of a keyboard.

Technical solution: a key structure of a keyboard stated according to the present invention comprises a keycap, a scissor connecting mechanism, a conductive circuit board and a bottom plate from top to bottom, wherein a projection is arranged between the scissor connecting mechanism and the conductive circuit board; when an optional position of the periphery of the keycap is pressed, the scissor connecting mechanism is in contact with the projection before the conductive circuit board or the bottom plate below the scissor connecting mechanism; and if the optional position of the periphery of the keycap continues being pressed, the scissor connecting mechanism positioned on one side of the pressed point is bent and deformed by using the projection as a fulcrum and is in contact with the conductive circuit board. In a whole process of pressing, the scissor connecting mechanism does not collide with various parts, and the hand feeling of the user is good.

Preferably, the projection is arranged on the bottom plate, and the protruding end of the projection passes through the conductive circuit board; and more preferably, the projection is integrally connected with the bottom plate, and formed by protruding from the surface of the bottom plate to the keycap.

The projection is also arranged on the scissor connecting mechanism; further, the scissor connecting mechanism comprises an inner scissor frame and an outer scissor frame, and the projection may be arranged on the inner scissor frame and/or the outer scissor frame; and still further, the projection is integrally connected with the scissor connecting mechanism, and may be formed by protruding from the surface of the inner scissor frame or the outer scissor frame to the bottom plate.

To be specific, the outer scissor frame and the inner scissor frame are rectangle frames, the outer scissor frame comprises a pair of outer frame side arms connected with the inner scissor frame, the inner scissor frame comprises a pair of inner frame side arms connected with the outer scissor frame, and the projection is located on the outer frame side arms and/or the inner frame side arms.

Preferably, the position of the projection is corresponding to a one-third area of the middle of a long side of the outer frame side arms.

Beneficial effects: compared with the prior art, the present invention has the obvious advantages that: according to the key structure of a keyboard of the present invention, the projection is arranged between the scissor connecting mechanism and the conductive circuit board, in a process of pressing the position on the periphery of the keycap until the keycap reaches the bottom end, the scissor connecting mechanism is in contact with the projection at first, rather than directly colloids with the conductive circuit board and the bottom plate; and the scissor connecting mechanism will be bent and deformed and then is in contact with various parts if the position is continuously pressed, the pressing collision during the whole process is buffered to a certain extent, so that the contact between various parts is no longer hard collision, and the hand pressing feeling is good.

DETAILED DESCRIPTIONS

The technical solution of the present invention will be further described hereinafter with reference to the drawings.

Figure 1A:
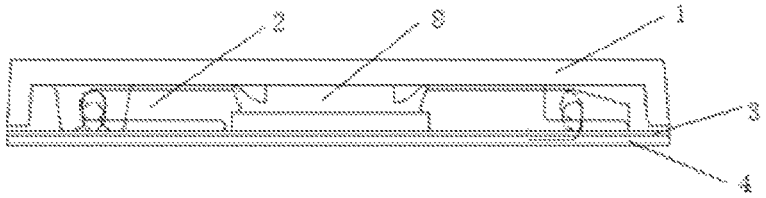
FIG. 1*a* is a schematic diagram illustrating matching between a scissor connecting mechanism and a keycap, a bottom plate and a conductive circuit board when a middle part of the keycap of a traditional keyboard is pressed to the bottom.
Figure 1B:
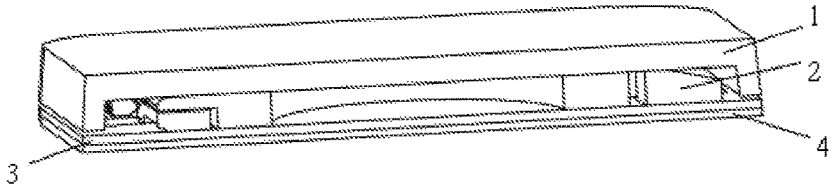
FIG. 1*b* is a front view illustrating a matching status between scissor connecting mechanism and the keycap, the bottom plate and the conductive circuit board when a position on the periphery of the keycap of the traditional keyboard is pressed to the bottom.
Figure 1C:
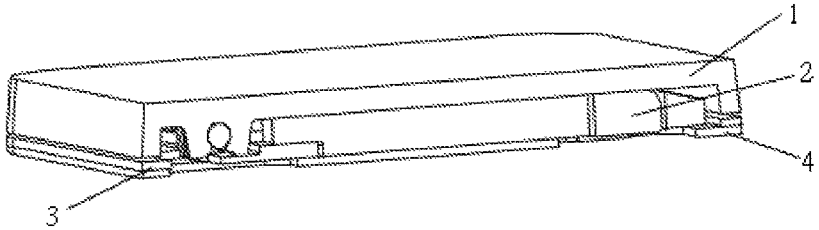
FIG. 1*c* is a back view illustrating a matching status between the scissor connecting mechanism, and the keycap, the bottom plate and the conductive circuit board when the position on the periphery of the keycap of the traditional keyboard is pressed to the bottom.
Figure 2:
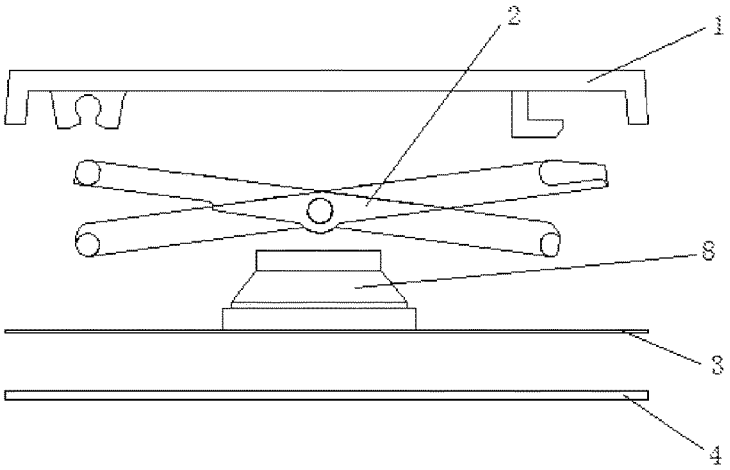
FIG. 2 is a schematic diagram illustrating a key structure of a keyboard according to the present invention.

As illustrated in FIG. 2, the key structure of a keyboard of the present invention comprises a keycap 1, a scissor connecting mechanism 2, a conductive circuit board 3 and a bottom plate 4 from top to bottom, and further comprises an elastomer 8. An upper part of the elastomer 8 passes through an axle hole of the scissor connecting mechanism 2 and is connected with the keycap 1, while a bottom part of the elastomer is connected with the conductive circuit board 3.

A projection 5 is arranged between the scissor connecting mechanism 2 and the conductive circuit board 3. When the periphery of the keycap 1 is pressed, the scissor connecting mechanism 2 is in contact with the projection 5 before the conductive circuit board 3 or the bottom plate 4 below the scissor connecting mechanism at first to transmit the pressing force to the projection 5, rather than directly colloids with the keycap 1, the conductive circuit board 3 and the bottom plate 4; and if the periphery of the keycap continues being pressed, the scissor connecting mechanism 2 is downwards bent and deformed by using the projection as a fulcrum and is in contact with the conductive circuit board 3. The deformation process has a stress buffer effect, so that the contact between various parts is no longer hard collision, and good hand pressing feeling is obtained.

The quantity of the projection 5 may be one or more. The projection may either be arranged on the bottom plate 4, or arranged on the scissor connecting mechanism 2, and may further be arranged on the bottom plate 4 and the scissor connecting mechanism 2 at the same time.

Figure 3A:
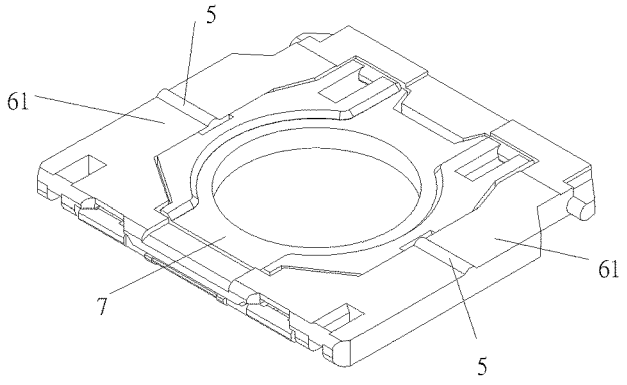
FIG. 3*a* is a schematic diagram illustrating a scissor connecting mechanism in a first embodiment.
Figure 3B:
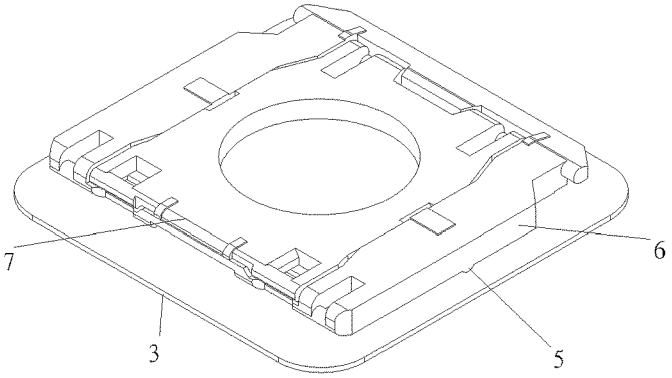
FIG. 3*b* is a schematic diagram illustrating the contract between a projection on the scissor connecting mechanism and a conductive circuit board in the first embodiment.
Figure 4:
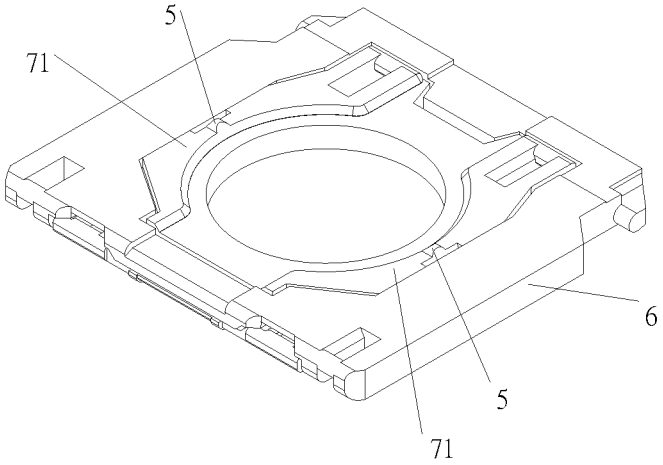
FIG. 4 is a schematic diagram of the scissor connecting mechanism in a transformation embodiment of the first embodiment.
Figure 5:
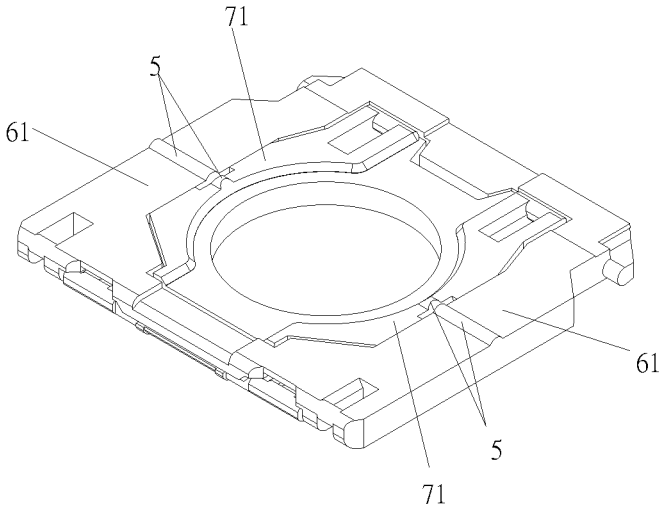
FIG. 5 is a schematic diagram illustrating the scissor connecting mechanism in another transformation embodiment of the first embodiment.

The scissor connecting mechanism 2 comprises an outer scissor frame 6 and an inner scissor frame 7, the outer scissor frame 6 and the inner scissor frame 7 are rectangle frames, the outer scissor frame 6 comprises a pair of outer frame side arms 61 connected with the inner scissor frame 7 and a pair of outer frame base arms adjacent to the inner frame side arms 71, the projection 5 may be located on the outer frame side arms 61 or the inner frame side arms 71 as illustrated in FIG. 3*b* and FIG. 4, or the projection 5 is arranged on the outer frame side arms 61 or the inner frame side arms 71 as illustrated in FIG. 5.

Figure 6A:
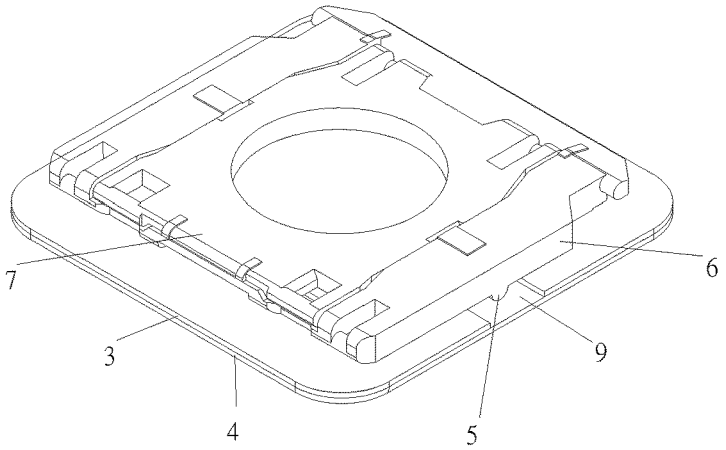
FIG. 6*a* is a schematic diagram illustrating the contract between a projection on a scissor connecting mechanism and a bottom plate in a second embodiment.
Figure 7A:
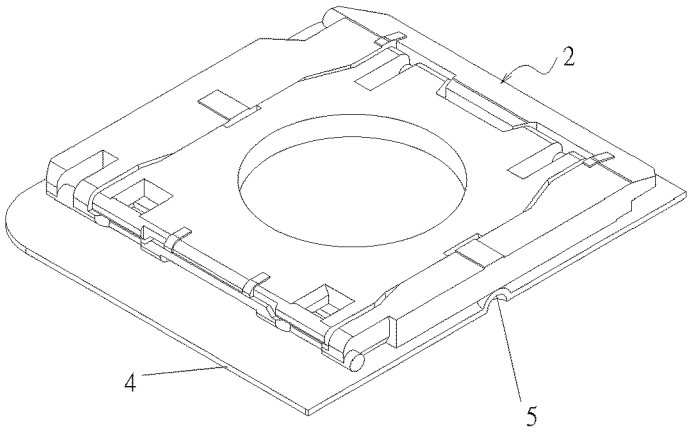
FIG. 7*a* is a schematic diagram illustrating the contract between a scissor connecting mechanism and a projection on a bottom plate in a third embodiment.

When the projection 5 is located on the bottom plate 4, as illustrated in FIG. 7*a*, the protruding end of the projection passes through the conductive circuit board 3, so that the scissor connecting mechanism 2 is in contact with the projection 5 during pressing; and when the projection 5 is located on the scissor connecting mechanism 2, the protruding end may be only in contact with the conductive circuit board 3 when an optional position of the periphery of the keycap is pressed, as illustrated in FIG. 3*b*, and may also pass through the conductive circuit board 3 and be in contact with the bottom plate 4, as illustrated FIG. 6*a*.

The projection 5 may be fixed on the surface of the scissor connecting mechanism 2 or the bottom plate 4 through adhesion or other ways as an independent part, and may also connected with the scissor connecting mechanism 2 or the bottom plate 4 in a whole as a part of the scissor connecting mechanism 2 or the bottom plate 4.

The projection 5 may be located at any position in the contract range of the scissor connecting mechanism 2 with the conductive circuit board 3 and the bottom plate 4; in order to make the projection 5 better bear the scissor connecting mechanism 2 to make the scissor connecting mechanism have a better deformation buffer effect, the position of the projection shall be corresponding to the middle area of the scissor connecting mechanism to a certain extent; and the middle are is a one-third area in the middle of the long side of the outer frame side wall 61, i.e., the area between one-third position to two-thirds position of the side length of the long side of the outer frame side wall 61.

The convex surface of the projection 5 may be of a plurality of shapes, and is preferably of a smooth arc, so as to avoid sharp collision occurred when the convex surface is in contact with the scissor connecting mechanism 2, the conductive circuit board 3 or the bottom plate 4.

Embodiment 1

As a preferable embodiment of the present invention, and as illustrated in FIGS. 3*a* to 3*e*, the scissor connecting mechanism 2 comprises the outer scissor frame 6 and the inner scissor frame 7, the projection 5 is arranged on the outer scissor frame 6, located at the middle part of the outer frame side arms 61, and is formed by protruding from the surface of the outer frame side arm 61 to the bottom plate 4; in order to make the structural illustration of the projection in the scissor connecting mechanism more intuitional, FIG. 3*a* is a schematic diagram illustrating the scissor connecting mechanism after turning over by 180 degrees from an assembly state in the embodiment; and similarly, FIG. 4 and FIG. 5 are also schematic diagrams illustrating the scissor connecting mechanism after turning over by 180 degrees from an assembly state in the corresponding embodiment.

Figure 3C:
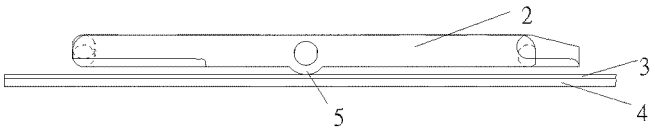
FIG. 3*c* is a schematic diagram illustrating matching between the projection on the scissor connecting mechanism in contact with the conductive circuit board at first in the first embodiment.
Figure 3D:
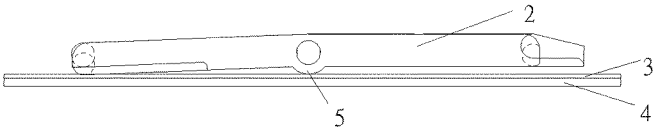
FIG. 3*d* is a schematic diagram illustrating matching between the scissor connecting mechanism, and the conductive circuit board and the bottom plate when the left side of the keycap is pressed until the scissor connecting mechanism is deformed in the first embodiment.

When the key is not pressed, the outer frame and the inner frame of the scissor connecting mechanism 2 are intercrossed in an X-shaped structure, and the projection 5 is not in contact with the conductive circuit board 3 and the bottom plate 4; the position at the left side of the keycap is pressed to the bottom, in the pressing process, the scissor connecting mechanism 2 is pressed into a cross-followed structure from the X-shaped structure, then the pressing force is transmitted to the projection 5 on the outer scissor frame 61, and the projection 5 is in contact with the conductive circuit board 3 at first, as illustrated in FIGS. 3*b* and 3*c*; then the keycap is continuously pressed, as illustrated in FIG. 3*d*, a part of the scissor connecting mechanism at the left side of the projection 5 is downwards bent and deformed until being in contact with the conductive circuit board 3 by using the projection 5 as the fulcrum; and during this process, the scissor connecting mechanism 2 does not directly collide with the keycap 1, the conductive circuit board 3 and the bottom plate 4, but is in contract with the projection 5 at first, and then is in contact with various parts after the deformation buffer of the scissor connecting mechanism 2, and the pressing conduction process is buffered to a certain extent, so that the contact between various parts is no longer hard collision, and the hand pressing feeling is good.

Figure 3E:
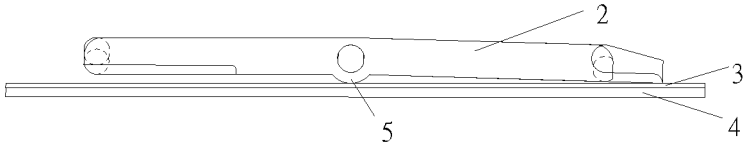
FIG. 3*e* is a schematic diagram illustrating matching between the scissor connecting mechanism, and the conductive circuit board and the bottom plate when the right side of the keycap is pressed until the scissor connecting mechanism is deformed in the first embodiment.

When the position at the right side of the keycap is pressed to the bottom, similarly, the projection 5 on the outer scissor frame 6 is in contact with the conductive circuit board 3 at first, and the pressing force is transmitted to the projection 5 firstly. A part of the scissor connecting mechanism 2 at the right side of the projection 5 is downwards bent and deformed until being in contact with the conductive circuit board 3 when the keycap is pressed continuously, as illustrated in FIG. 3*e*; similarly, the whole pressing conduction process is buffered, so that no sharp collision may be generated between various parts, and the user may have a better hand pressing feeling.

As a transformation of the embodiment, and as illustrated in FIG. 4, the projection 5 is arranged on the inner scissor frame 7, located at the middle part of the inner frame side arms 71, and is formed by protruding from the surface of the inner frame side arm 71 to the bottom plate 4. During the process of pressing the position at the left side of the keycap 1 to the bottom, only the projection 5 is in contact with the conductive circuit board 3 at first; and a part of the scissor connecting mechanism on the left side of the projection 5 is downwards bent and deformed to be in contact with the conductive circuit board 3 by using the projection 5 as the fulcrum when the keycap is continuously pressed, and a schematic diagram illustrating matching between the scissor connecting mechanism 2, and the conductive circuit board 3 and the bottom plate 4 in the pressing conduction process can be referred to FIGS. 3*b* to 3*d*; similarly, when pressing the position at the right side of the keycap, a schematic diagram illustrating matching between the scissor connecting mechanism 2, and the conductive circuit board 3 and the bottom plate 4 in the pressing conduction process may be referred to in FIGS. 3*b*, 3*c* and 3*e*.

As another transformation of the embodiment, and as illustrated in FIG. 5, both the inner scissor frame 7 and the outer scissor frame 6 are provided with a projection 5, and the projection 5 is respectively located at the middle part of the outer frame side arms 61 and the middle part of the inner frame side arms 71, and is integrally connected with the outer frame side arms 61 or the inner frame side arms 71 respectively. A matching mode of the scissor connecting mechanism 2 with the conductive circuit board 3 and the bottom plate 4 is similar to the embodiment when any optional position of the periphery of the keycap 1 is pressed.

Embodiment 2

In another preferable embodiment of the present invention, the position of the projection 5 is the same as that in the embodiment 1. The difference lies in that the position corresponding to the projection 5 on the conductive circuit board 3 is provided with a through hole 9, and the protruding end of the projection 5 may pass through the through hole 9 to be in contact with the bottom plate 4.

Figure 6B:
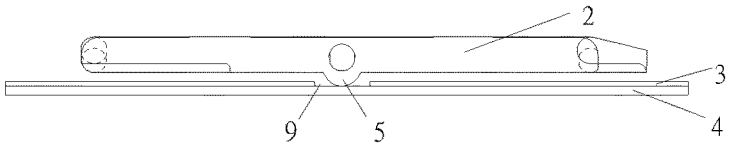
FIG. 6*b* is a schematic diagram illustrating matching when the projection on the scissor connecting mechanism is in contact with the bottom plate at first in the second embodiment.
Figure 6C:
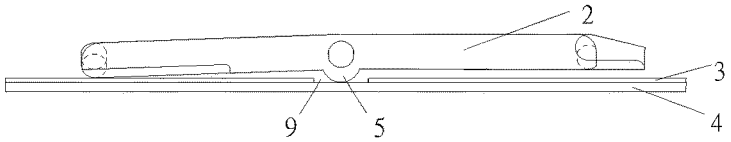
FIG. 6*c* is a schematic diagram illustrating matching between the scissor connecting mechanism, and the conductive circuit board and the bottom plate when the left side of a keycap is pressed until the scissor connecting mechanism is deformed in the second embodiment.
Figure 6D:
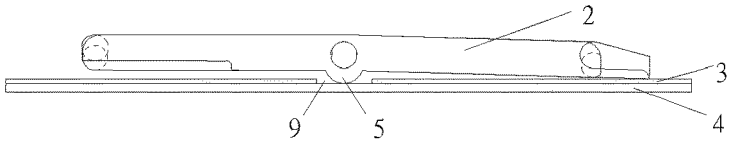
FIG. 6*d* is a schematic diagram illustrating matching between the scissor connecting mechanism, and the conductive circuit board and the bottom plate when the right side of the keycap is pressed until the scissor connecting mechanism is deformed in the second embodiment.

When the key is not pressed, the outer frame and the inner frame of the scissor connecting mechanism 2 are intercrossed in an X-shaped structure, and the projection 5 is not in contact with the conductive circuit board 3 and the bottom plate 4; the position at the left side of the keycap is pressed to the bottom, in the pressing process, the scissor connecting mechanism 2 is pressed into a cross-followed structure from the X-shaped structure, the pressing force is transmitted to the projection 5 on the outer scissor frame 61, and the projection 5 passes through the through hole 9 on the conductive circuit board 3 to be in contact with the bottom plate 4, as illustrated in FIGS. 6*a* and 6*b*; then the keycap is continuously pressed, as illustrated in FIG. 6*c*, a part of the scissor connecting mechanism at the left side of the projection 5 is downwards bent and deformed until being in contact with the conductive circuit board 3 by using the projection 5 as the fulcrum; when the position at the right side of the keycap 1 is pressed to the bottom, the projection 5 on the scissor connecting mechanism 2 passes through the through hole 9 on the conductive circuit board 3 to be in contact with the bottom plate 4 at first, then the keycap is continuously pressed as illustrated in FIG. 6*d*, a part of the scissor connecting mechanism 2 at the right side of the projection 5 is downwards bent and deformed, and is in contact with the conductive circuit board 3.

In the process above, the projection 5 is in contact with the bottom plate 4 at first, and then the projection is in contact with various parts after the deformation buffer of the scissor connecting mechanism 2. The scissor connecting mechanism 2 does not directly collide with the keycap 1, the conductive circuit board 3 and the bottom plate 4, so that the pressing conduction process is buffered at the same time, and the hand pressing feeling is good.

Embodiment 3

In the third preferable embodiment of the present invention, the projection 5 is arranged on the bottom plate 4, as illustrated in FIGS. 7*a* to 7*d*. The projection 5 is located at the middle part of the bottom plate 4, and formed by protruding from the surface of the bottom plate 4 to the keycap 1, and the protruding end of the projection passes through the conductive circuit board 3.

Figure 7B:
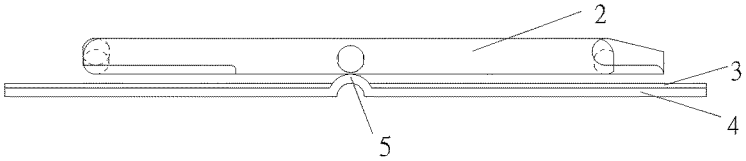
FIG. 7*b* is a schematic diagram illustrating matching between the scissor connecting mechanism in contact with the projection on the bottom plate at first in the third embodiment.
Figure 7C:
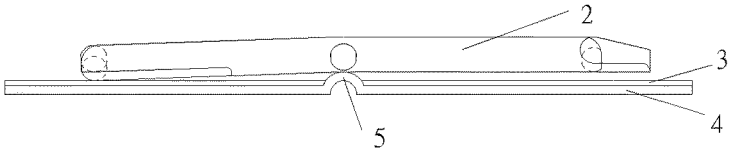
FIG. 7*c* is a schematic diagram illustrating matching between the scissor connecting mechanism and the bottom plate when the left side of a keycap is pressed until the scissor connecting mechanism is deformed in the third embodiment.
Figure 7D:
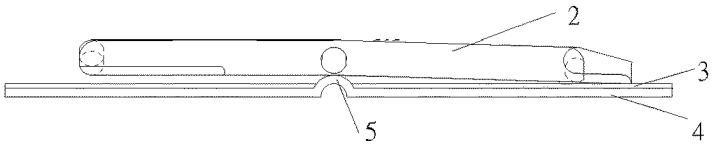
FIG. 7*d* is a schematic diagram illustrating matching between the scissor connecting mechanism and the bottom plate when the right side of the keycap is pressed until the scissor connecting mechanism is deformed in the second embodiment.

When the key is not pressed, the outer frame and the inner frame of the scissor connecting mechanism 2 are intercrossed in an X-shaped structure, and the projection 5 is not in contact with the scissor connecting mechanism 2; the position at the left side of the keycap 1 is pressed to the bottom, in the pressing process, and as illustrated in FIG. 7*b*, the scissor connecting mechanism 2 is pressed into a cross-followed structure from the X-shaped structure, and then is in contact with the projection 5 on the bottom plate 4 at first to transmit the pressing force to the projection 5; then the keycap is continuously pressed, as illustrated in FIG. 7*c*, a part of the scissor connecting mechanism at the left side of the projection 5 is downwards bent and deformed, and is in contact with the conductive circuit board 3 by using the projection 5 as the fulcrum; when the position at the right side of the keycap 1 is pressed to the bottom, the scissor connecting mechanism 2 is in contact with the projection 5 on the bottom plate 4 at first; then the keycap is continuously pressed as illustrated in FIG. 7*d*, a part of the scissor connecting mechanism 2 at the right side of the projection 5 is downwards bent and deformed, and is in contact with the conductive circuit board 3.

In the two pressing conduction processes above, the scissor connecting mechanism 2 does not collide with the parts such as the bottom plate 4, but is in contact with the projection 5 on the bottom plate 4, and then in contact with various parts after being deformed by the scissor connecting mechanism 2. The whole pressing conduction process is buffered, the scissor connecting mechanism 2 does not have sharp collision with various parts, and the user may have good hand pressing feeling.

The invention claimed is:

1. A key structure of a keyboard, comprising a keycap, a scissor connecting mechanism, a conductive circuit board and a bottom plate from top to bottom, wherein a projection is arranged between the scissor connecting mechanism and the conductive circuit board; when an optional position of the periphery of the keycap is pressed, the scissor connecting mechanism is in contact with the projection before the conductive circuit board or the bottom plate below the scissor connecting mechanism; and if the optional position of the periphery of the keycap continues being pressed after initial contact with the projection and conductive circuit board, the scissor connecting mechanism is bent and deformed on one side of the projection toward the optional position of the periphery of the keycap by using the projection as a fulcrum against one of the conductive circuit board and bottom plate such that the side of the scissor connecting mechanism on which the optional position is located is in contact with the conductive circuit board.

2. The key structure of a keyboard according to claim 1, wherein the projection is arranged on the bottom plate, and a protruding end of the projection passes through the conductive circuit board.

3. The key structure of a keyboard according to claim 2, wherein the projection protrudes from the surface of the bottom plate to the keycap.

4. The key structure of a keyboard according to claim 1, wherein the projection is arranged on the scissor connecting mechanism.

5. The key structure of a keyboard according to claim 4, wherein the scissor connecting mechanism comprises an outer scissor frame and an inner scissor frame, and the projection is arranged on the outer scissor frame and/or the inner scissor frame.

6. The key structure of a keyboard according to claim 5, wherein the outer scissor frame and the inner scissor frame are rectangle frames, the outer scissor frame comprises a pair of outer frame side arms connected with the inner scissor frame, the inner scissor frame comprises a pair of inner frame side arms connected with the outer scissor frame, and the projection is located on the outer frame side arms and the inner frame side arms.

7. The key structure of a keyboard according to claim 4, wherein the projection is integrally connected with the scissor connecting mechanism, and formed by protruding from the surface of the inner scissor frame or the outer scissor frame to the bottom plate.

8. The key structure of a keyboard according to claim 1, wherein the scissor connecting mechanism comprises an outer scissor frame and an inner scissor frame, the outer scissor frame is a rectangle frame, the outer scissor frame comprises a pair of outer frame side arms connected with the inner scissor frame, and the position of the projection is corresponding to a one-third area of the middle of a long side of the outer frame side arms.

9. The key structure of a keyboard according to claim 1, wherein the projection is located on the inner frame side arms.

10. A key structure of a keyboard, comprising a keycap, a scissor connecting mechanism, a conductive circuit board and a bottom plate from top to bottom, wherein a projection is arranged between the scissor connecting mechanism and the bottom plate;

when an optional position of the periphery of the keycap is pressed, the scissor connecting mechanism makes contact with the projection and the conductive circuit board or the bottom plate below the scissor connecting mechanism; and when the keycap is not pressed, the scissor connecting mechanism and the projection are distanced from each other.

11. A key structure of a keyboard, comprising a keycap, a scissor connecting mechanism, a conductive circuit board, and a bottom plate from top to bottom, wherein a projection is arranged between the scissor connecting mechanism and the conductive circuit board;

the circuit board further comprises a recess configured for receiving the projection;

when an optional position of the periphery of the keycap is pressed, the projection is in contact with the circuit board before the scissor connecting mechanism is in contact with the circuit board or bottom plate, and the scissor connecting mechanism is in contact with the projection before the conductive circuit board or the bottom plate below the scissor connecting mechanism.

12. The key structure of a keyboard according to claim 11 wherein the recess is a through hole configured for receiving the projection such that the projection contacts the bottom plate.

* * * * *